US008714788B2

(12) United States Patent
Lau

(10) Patent No.: US 8,714,788 B2
(45) Date of Patent: May 6, 2014

(54) SPOTLIGHT

(76) Inventor: Fermi Chi Hung Lau, Hongkong (HK)

( * ) Notice: Subject to any disclaimer, the term of this patent is extended or adjusted under 35 U.S.C. 154(b) by 89 days.

(21) Appl. No.: 13/425,438

(22) Filed: Mar. 21, 2012

(65) Prior Publication Data

US 2013/0250560 A1 Sep. 26, 2013

(51) Int. Cl.
*F21V 21/08* (2006.01)
*F21L 4/04* (2006.01)
*F21V 21/30* (2006.01)

(52) U.S. Cl.
USPC ..... 362/399; 362/199; 362/287

(58) Field of Classification Search
USPC ..... 362/187, 188, 197–199, 249.03, 362/249.07, 249.09, 249.1, 285, 399, 418, 362/419; 16/110.1, 422, 426, 430, DIG. 12, 16/DIG. 24, DIG. 25; 292/336.3, 347, 348, 292/349, 352–355, 359, DIG. 27, DIG. 30; 74/523–526, 543, 548; 403/322.4, 403/374.5
See application file for complete search history.

(56) References Cited

U.S. PATENT DOCUMENTS 2,228,009 A * 1/1941 Harford ..... 362/184
2,380,636 A * 7/1945 Drumm ..... 362/158
3,986,409 A * 10/1976 Tripp et al. ..... 74/548
5,019,951 A * 5/1991 Osterhout et al. ..... 362/191
6,056,414 A * 5/2000 Krieger ..... 362/184
6,394,631 B1 * 5/2002 Yuen ..... 362/399
6,419,377 B1 * 7/2002 Yuen ..... 362/399
2005/0270771 A1 * 12/2005 Yuen ..... 362/184
2006/0098437 A1 * 5/2006 Yuen ..... 362/287

FOREIGN PATENT DOCUMENTS

DE 202005000520 U1 * 5/2005

* cited by examiner

*Primary Examiner* — Hargobind S Sawhney
*Assistant Examiner* — Alexander Garlen
(74) *Attorney, Agent, or Firm* — David and Raymond Patent Firm; Raymond Y. Chan

(57) ABSTRACT

A spotlight includes a main housing, an illumination device received in the main housing and an angle adjusting arrangement. The angle adjusting arrangement includes an adjustable handle and a locking mechanism. The adjustable handle, having a predetermined curvature, is outwardly extended and rotatably mounted to the main housing and is arranged to selectively and rotatably move with respect to the main housing so as to selectively adjust an angle of inclination between the adjustable handle and the main housing. The locking mechanism is coupled between the adjustable handle and the main housing for selectively retaining the adjustable handle at a predetermined angle of inclination with respect to the main housing so that when the adjustable handle is held by a user, the illumination device is arranged to generate the illumination at a predetermined orientation corresponding with the angle of inclination of the adjustable handle.

11 Claims, 7 Drawing Sheets

SPOTLIGHT

BACKGROUND OF THE PRESENT INVENTION

1. Field of Invention

The present invention relates to an illumination device, and more particularly to a spotlight comprising an angle adjusting arrangement which is capable of conveniently and reliably adjusting an orientation of light beam generated by the spotlight.

2. Description of Related Arts

A conventional spotlight typically comprises a housing, a power source provided within the housing and an illuminating unit mounted in the housing and electrically connected with the power source, wherein the housing is held by a user or is attached on a user's body so that a user is able to hold the spotlight or wear on his or her body for performing his or her tasks. For a conventional spotlight, the housing usually has a handle bar outwardly extended therefrom for allowing a user to grip thereon.

There several disadvantages for this kind of conventional spotlight. First, the handle bar which is outwardly extended from the housing is usually immovable in the sense that an angle of inclination between the handle bar and the housing is not adjustable. This traditional disadvantage is very troublesome on user's perspective because when the user needs to adjust the orientation of the illumination, he or she has to manually hold the housing and point the illumination device at that desirable orientation for allowing sufficient amount of light to reach a particular spot.

Second, conventional spotlights such as the one described above usually is not designed for placing on a flat surface. As a result, when the user wishes to place the spotlight on a flat surface, such as on the ground surface, the housing, usually circular in cross section, may not be able to rest on the ground surface so that the user may not be able to work under constant and sufficient illumination.

Third, even when the housing of the spotlight may be able to rest on the flat surface, the user of the conventional spotlight may not be able to adjust the angle of illumination so that the user may not be able to work under proper lighting environment. For example, when the user wishes to put the spotlight on the ground surface because he or she needs to perform some work by using both of his or her hands, and he or she also desires to make the spotlight to tilt a little bit on the ground surface, he or she may not be able to do that because he or she may not get a proper support for the spotlight so as to make a slight angle of inclination with respect to ground surface.

SUMMARY OF THE PRESENT INVENTION

The invention is advantageous in that it provides a spotlight comprising an angle adjusting arrangement which is capable of conveniently and reliably adjusting an orientation of light beam generated by the spotlight.

Another advantage of the invention is to provide a spotlight comprising an angle adjusting arrangement, which is capable of adjusting an angle of orientation of the housing even when the spotlight light rests on a flat surface. This allows the user of the present invention to work on optimal lighting condition even if he or she does not manually hold the spotlight.

Another advantage of the invention is to provide a spotlight comprising an angle adjusting arrangement which is easy and convenient to operate so as to facilitate widespread application of the present invention.

Another advantage of the invention is to provide a spotlight comprising an angle adjusting arrangement which does not involve complicated mechanical or electrical structure. This means the manufacturing cost of the present invention can be minimized.

Another advantage of the invention is to provide a spotlight comprising an angle adjusting arrangement comprising an adjustable handle, which can be rotatably moved with respect to a main housing so as to vary the angle of inclination between the adjustable handle and the main housing.

Additional advantages and features of the invention will become apparent from the description which follows, and may be realized by means of the instrumentalities and combinations particular point out in the appended claims.

According to the present invention, the foregoing and other objects and advantages are attained by providing a spotlight, comprising:

a main housing;

an illumination device received in the main housing for generating illumination; and an angle adjusting arrangement which comprises:

an adjustable handle, having a predetermined curvature, outwardly extended and rotatably mounted to the main housing and is arranged to selectively and rotatably move with respect to the main housing so as to selectively adjust an angle of inclination between the adjustable handle and the main housing; and a locking mechanism coupled between the adjustable handle and the main housing for selectively retaining the adjustable handle at a predetermined angle of inclination with respect to the main housing so that when the adjustable handle is held by a user, the illumination device is arranged to generate the illumination at a predetermined orientation corresponding with the angle of inclination of the adjustable handle.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1A:
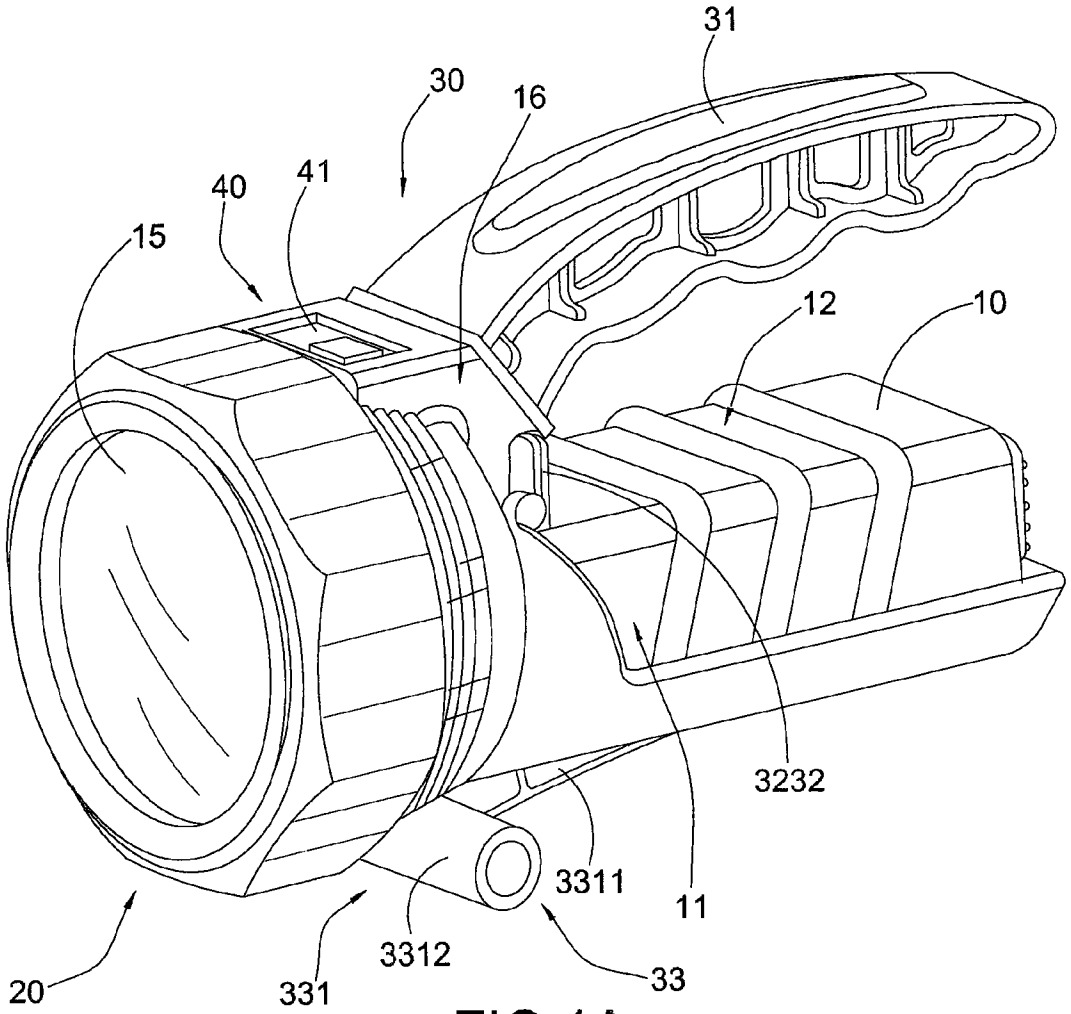
FIG. 1A and FIG. 1B are perspective views of a spotlight according to a preferred embodiment of the present invention.

Referring to FIG. 1A, FIG. 1B, FIG. 2, FIG. 3A, FIG. 3B and FIG. 4A to FIG. 4B of the drawings, a spotlight according to a preferred embodiment of the present invention is illustrated, in which the spotlight comprises a main housing 10, an illumination device 20, and an angle adjusting arrangement 30. The illumination device 20 is received in the main housing 10 for generating illumination. The angle adjusting arrangement 30 comprises an adjustable handle 31, and a locking mechanism 32.

The adjustable handle 31 is outwardly extended and rotatably mounted to the main housing 10 and is arranged to selectively and rotatably move with respect to the main housing 10 so as to selectively adjust an angle of inclination between the adjustable handle 31 and the main housing 10.

On the other hand, the locking mechanism 32 is coupled between the adjustable handle 31 and the main housing 10 for selectively retaining the adjustable handle 31 at a predetermined angle of inclination with respect to the main housing 10 so that when the adjustable handle 31 is held by a user, the illumination device 20 is arranged to generate the illumination at a predetermined orientation corresponding with the angle of inclination of the adjustable handle 31.

Figure 1B:
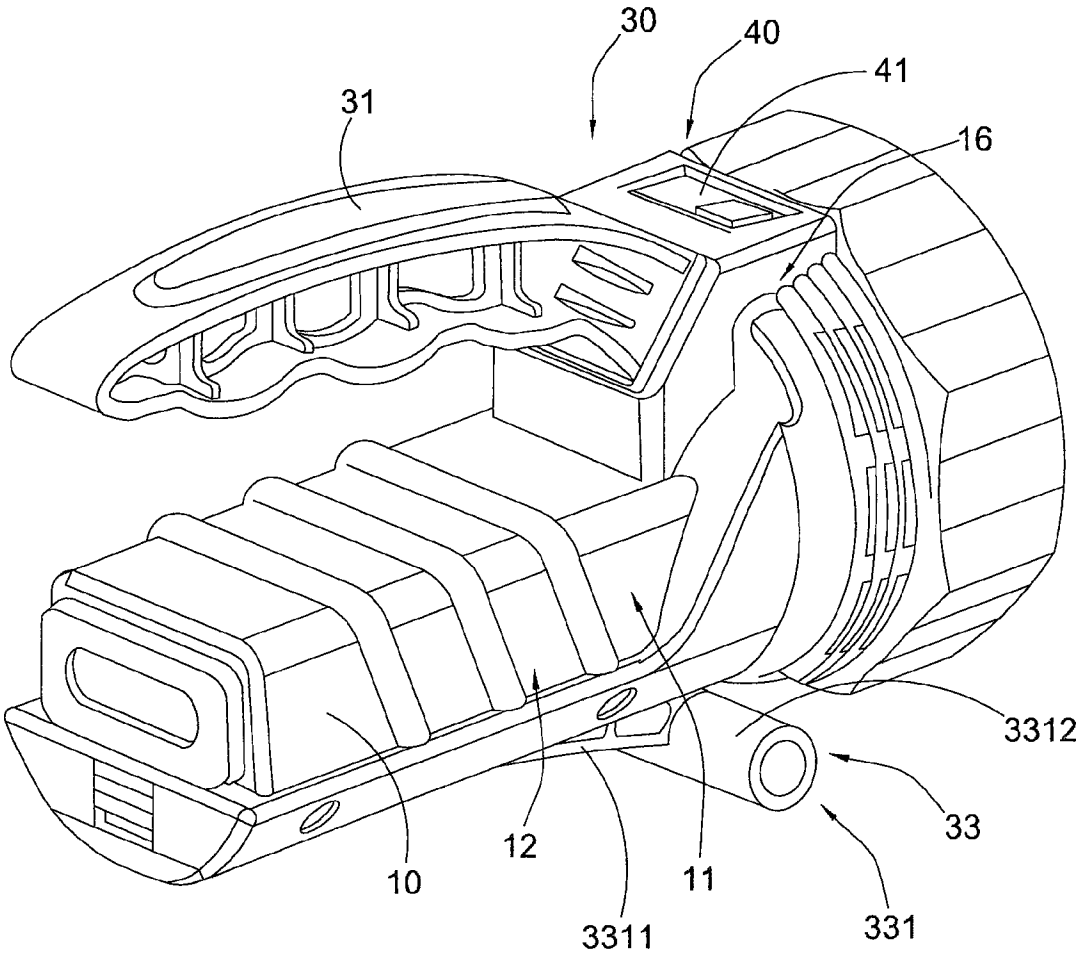

According to the preferred embodiment of the present invention, the main housing 10 is elongated in shape and has a front end portion 11, a main portion 12 rearwardly extended from the front end portion 11, and a receiving cavity 13 formed within the main housing 10 to define a battery compartment 131 at the main portion 12 for accommodating a predetermined number of batteries, and an electrical compartment 132 for receiving the illumination device 20. As shown in FIG. 1A and FIG. 1B of the drawings, the front end portion 11 of the main housing 10 is substantially circular in cross sectional shape, while the main portion 12 of the main housing 10 is substantially rectangular in cross sectional shape, wherein the receiving cavity 13 is extended within the front end portion 11 and the main housing 10. It is worth mentioning that the front end portion 11 of the main housing 10 has a cross sectional area which is substantially larger than that of the main portion 12 of the main housing 10.

The illumination device 20 comprises at least one illuminator 21 supported in the front end portion 11 of the main housing 10, and is electrically connected to the battery received in the battery compartment 131 of the main housing 10 for acquiring electricity to provide illumination. The illuminator 21 is preferably embodied as a LED which is capable of generating illumination at a predetermined intensity.

The illumination device 20 further comprises a light reflector 22 provided in the front end portion 11 of main housing 10, wherein the light reflector 22 is conical in structure and is arranged to reflect light coming out from the illuminator 21 toward an exterior of the main housing 10. Thus, the main housing 10 further has a front window 14 formed at the front end portion 11 which communicates the receiving cavity 13 with an exterior of the main housing 10, wherein the light generated by the illuminator 21 is arranged to reach an exterior of the main housing 10 through this front window 14. A transparent cover 15 is mounted at the front window 14 for protecting the illuminator 21 from surrounding environment.

The main housing 10 further has a control portion 16 provided at an intersection between the front end portion 11 and the main portion 12 for accommodating the locking mechanism 32 of the angle adjusting arrangement 30 and for rotatably supporting the adjustable handle 31. Moreover, the spotlight of the present invention further comprises a control mechanism 40 accommodated in the control portion 16 of the main housing 10 and is operatively connected to the illumination device 20 for controlling an operation thereof. More specifically, the control mechanism 40 comprises a control switch 41 operatively provided on the control portion 16 of the main housing 10 for selectively actuating the illuminator 21 to generate illumination. Note that the control switch 41 is provided at a position in front of the adjustable handle 31 so as to allow the user to conveniently operate the control switch 41 while holding the adjustable handle 31.

Figure 3A:
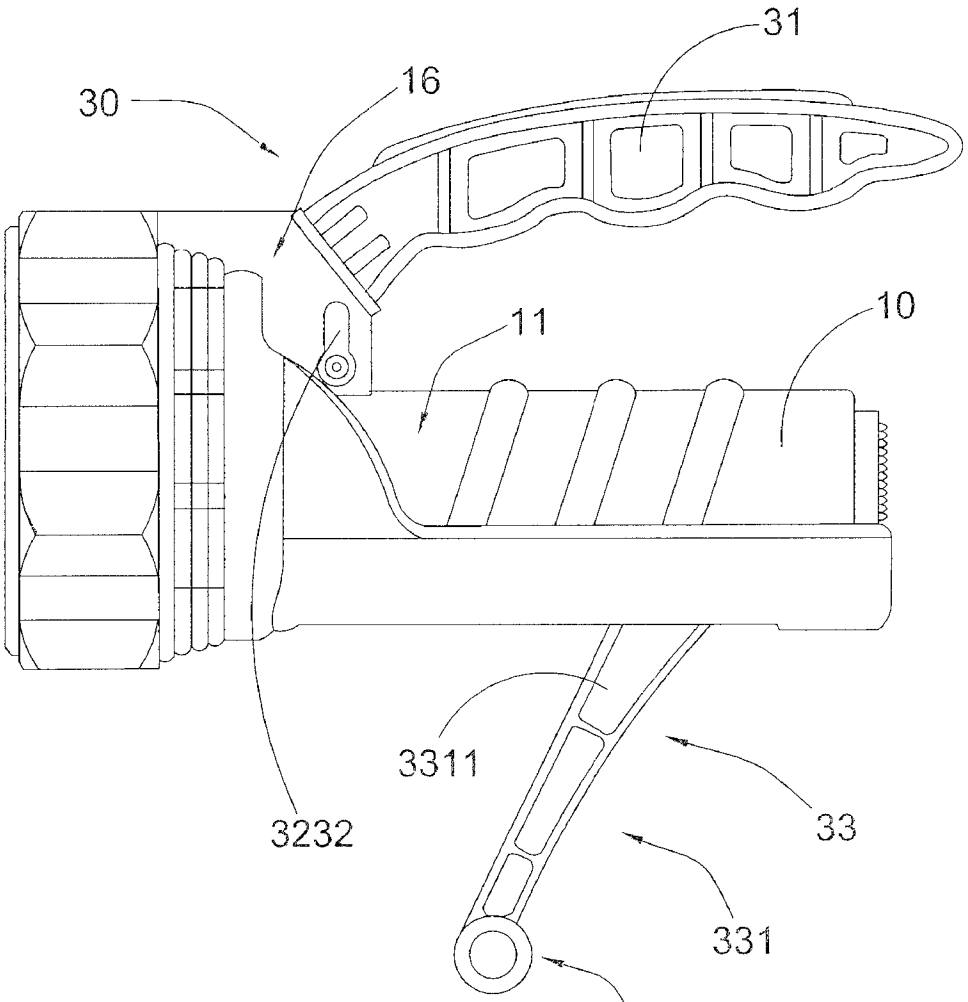
FIG. 3A and FIG. 3B are side views of the spotlight according to the above preferred embodiment of the present invention.
Figure 3B:
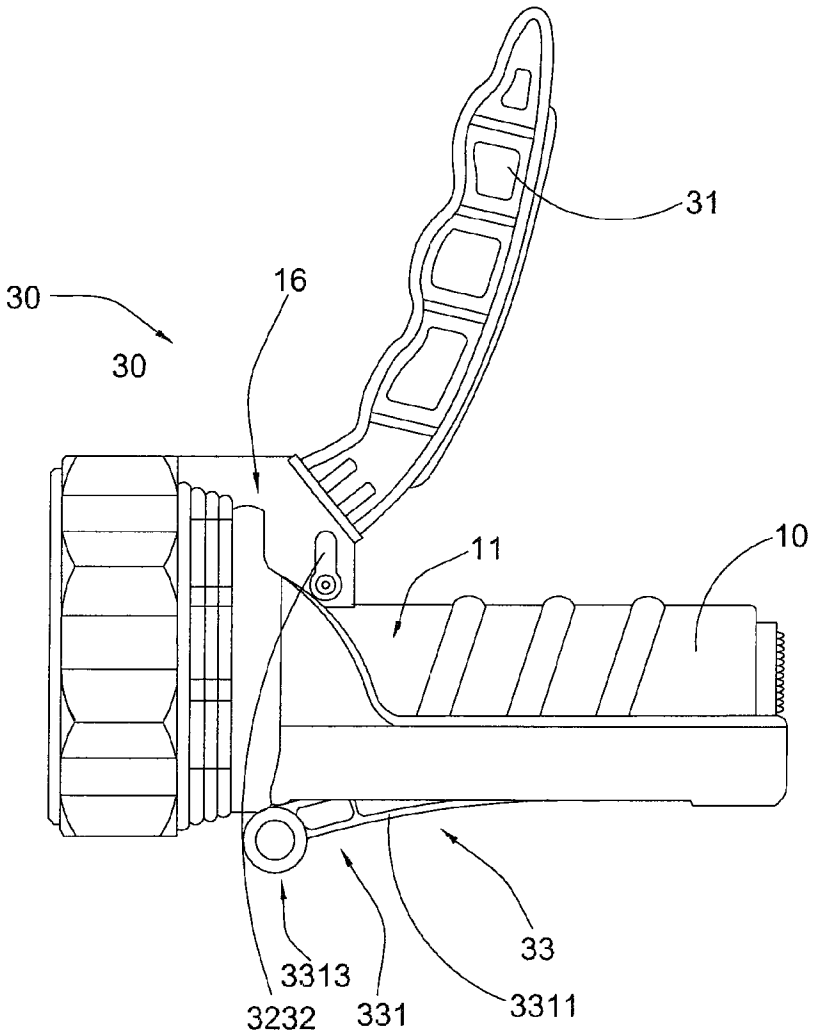

The adjustable handle 31 of the angle adjusting arrangement 30 is elongated in shape and is rearwardly extended from the control portion 16 of the main housing 10. In this preferred embodiment, the adjustable handle 31 has a curved cross sectional shape so as to ergonomically fit a user's hand. Moreover, when the adjustable handle 31 is rotatably moved with respect to the main housing 10, an angle of inclination of the adjustable handle 31 with respect to the main housing 10 is thereby altered, as shown in FIG. 3A and FIG. 3B of the drawings.

Figure 2:
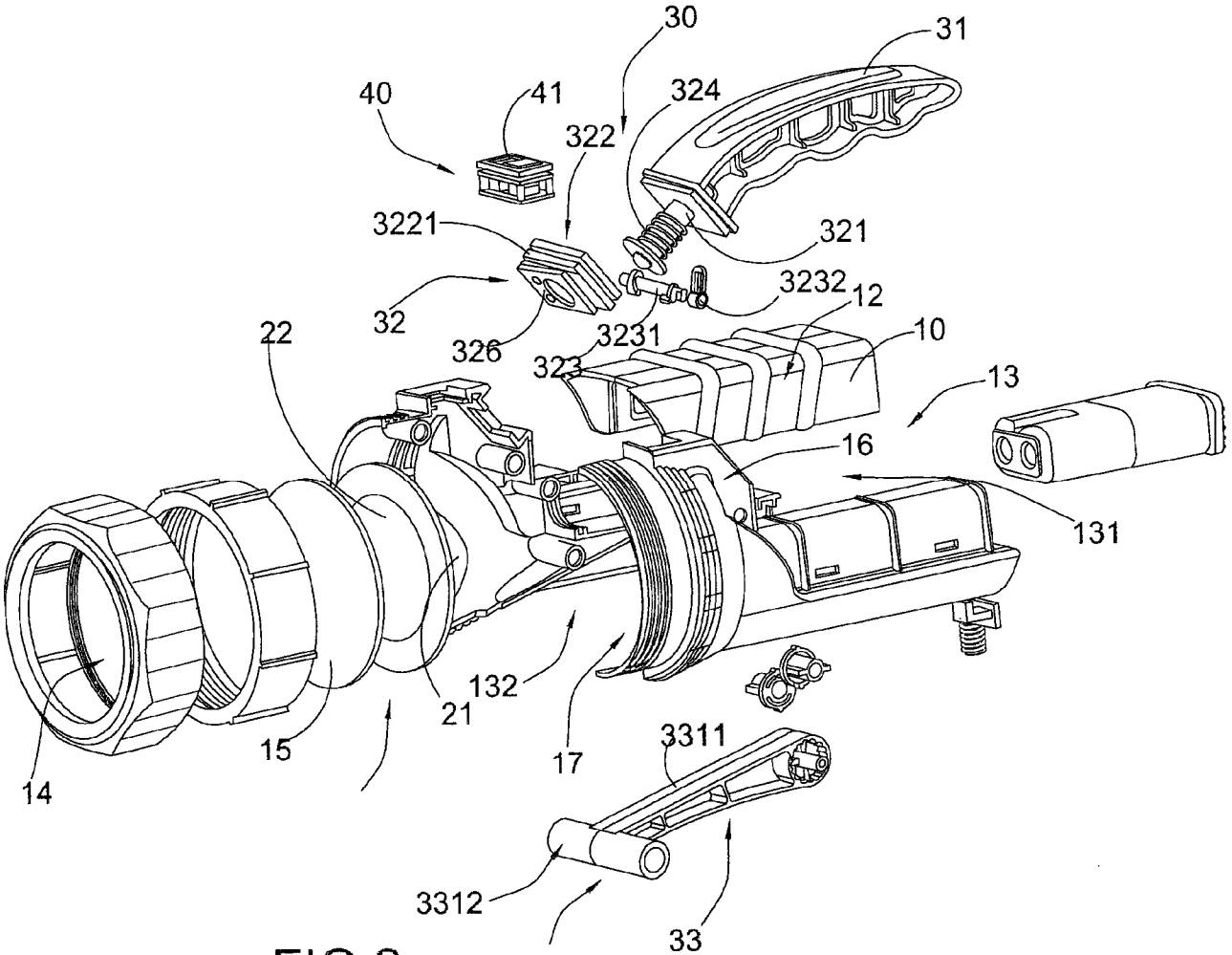
FIG. 2 is an exploded perspective view of the spotlight according to the above preferred embodiment of the present invention.
Figure 4A:
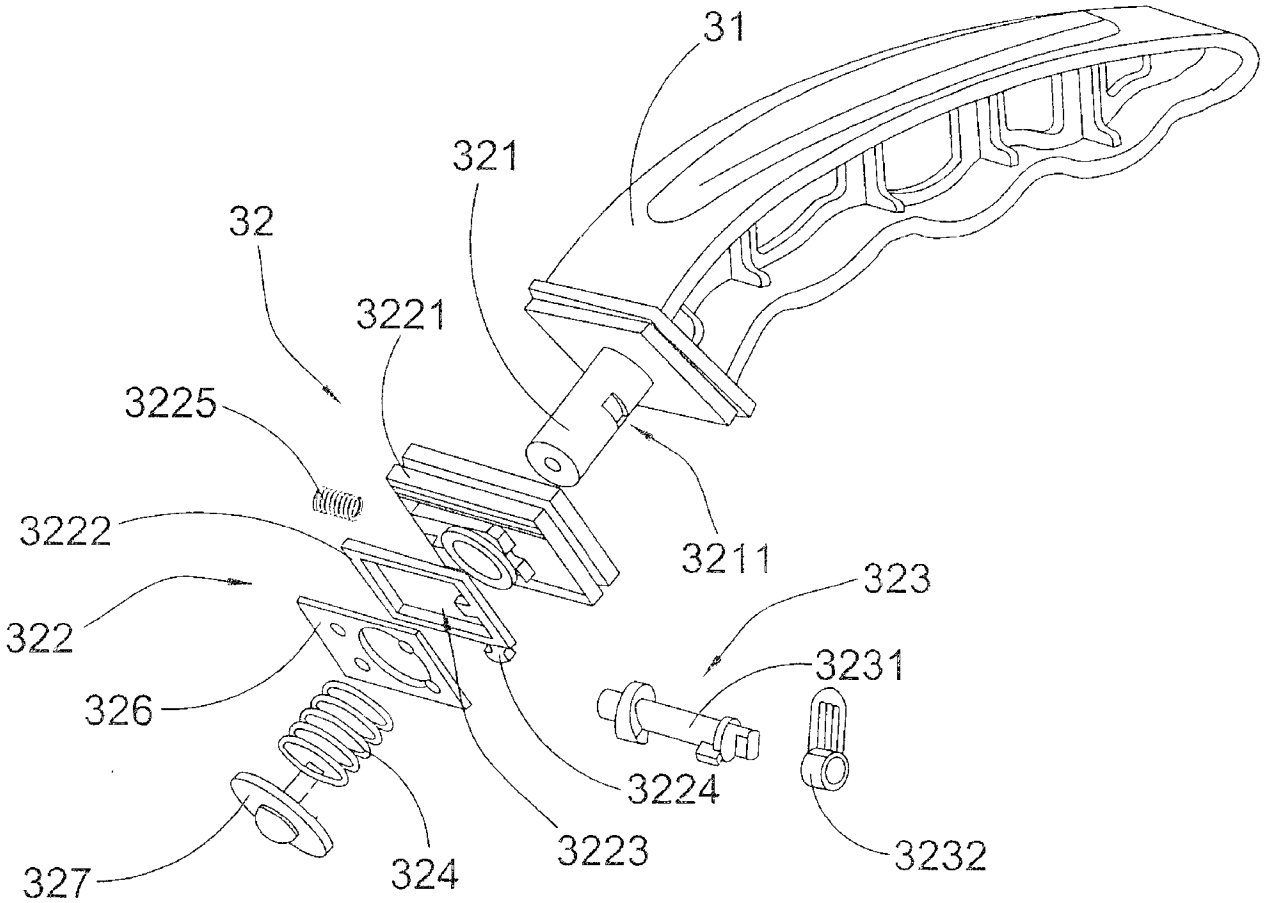
FIG. 4A and FIG. 4B are schematic diagrams of the handle adjusting arrangement of the spotlight according to the above preferred embodiment of the present invention.
Figure 4B:
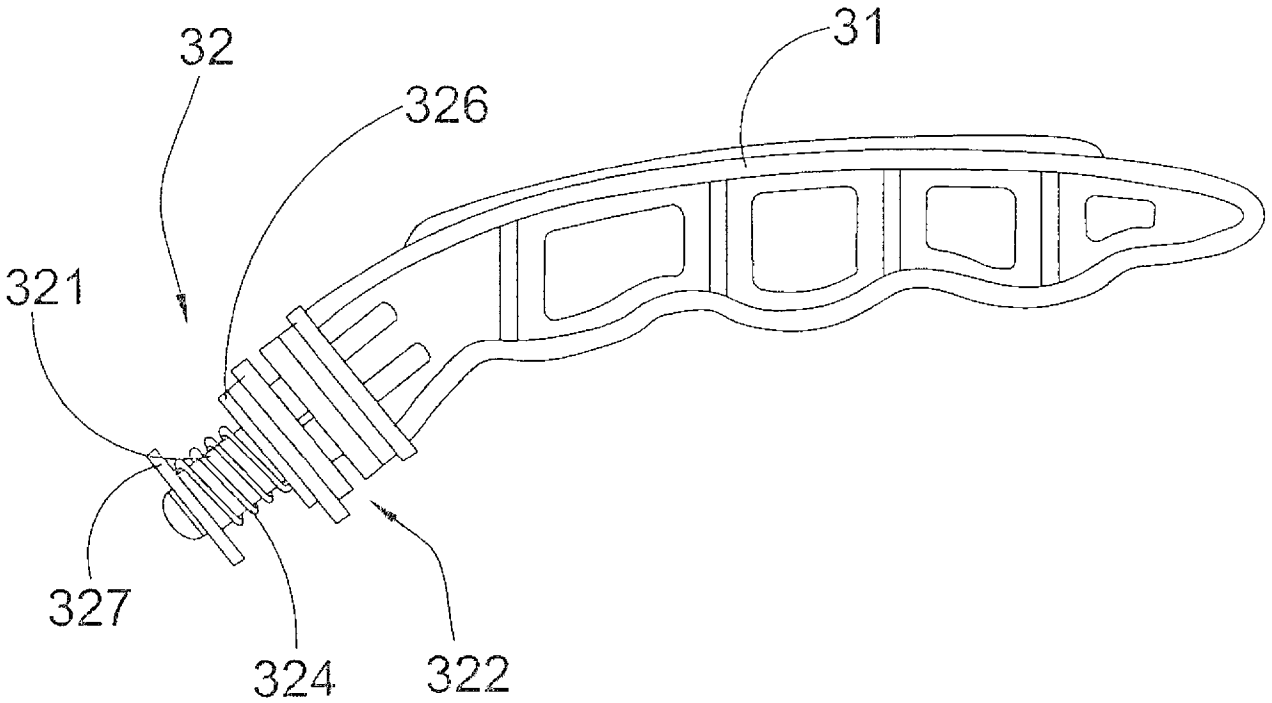

Referring to FIG. 2 and FIG. 4A to FIG. 4B of the drawings, the locking mechanism 32 of the handle adjusting arrangement 30 comprises a supporting shaft 321 extended from a front end of the adjustable handle 31 such that the adjustable handle 31 is capable of rotating about the supporting shaft 321, a shaft locker 322 supported at the control portion 16 of the main housing 10 and is operatively coupled with the supporting shaft 321, and a locker switch 323 also provided on the control portion 16 of the main housing 10 for selectively locking a rotational movement of the supporting shaft 321.

More specifically, the adjustable handle 31 and the supporting shaft 321 is also coupled with the shaft locker 322 in such a manner that the supporting shaft 321 and the adjustable handle 31 is also capable of moving in a longitudinal manner (i.e. in an axial direction of the supporting shaft 321). The supporting shaft 321 further has a locking slot 3211 formed thereon. The shaft locker 322 comprises an upper locking frame 3221 and a lower locking frame 3222 overlappedly received in the upper locking frame 3221. Each of the upper locking frame 3221 and the lower locking frame 3222 has a through slot 3223 formed thereon for allowing the supporting shaft 321 to pass therethrough. Moreover, the lower locking frame 3222 has locking latch 3224 inwardly extended from a sidewall of the corresponding through slot 3223 in such a manner that the locking latch 3224 is arranged to engage with the locking slot 3211 of the supporting shaft 321 so as to restrict rotational as well as linear movement thereof.

The locker switch 323 comprises a locking shaft member 3231 movably provided on the control portion 16 of the main housing, and a switching knob 3232 pivotally mounted on the control portion 16, wherein the locking shaft member 3231 is extended from the switching knob 3232 to selectively bias against the lower locking frame 3222 so as to allow the locking latch 3224 to selectively engage to and disengage from the locking slot 3211. In this preferred embodiment, the switching knob 3232 is pivotally moved on the control portion 16 of the main housing 10 for allowing the locking shaft member 3231 to normally biasing against the lower locking frame 3222 so as to normally facilitate engagement between the locking latch 3224 of the lower locking frame 3222 and the locking slot 3211 of the supporting shaft 321.

It is important to mention, however, that the shaft locker 322 further comprises an elastic member 3225 mounted on the upper locking frame 3221 for normally exerting an axial biasing force toward the lower locking frame 3222 for disengaging the lower locking frame 3222 from the supporting shaft 321. Thus, when the switching knob 3232 is pivotally moved to release a biasing force against the lower locking frame 3222, the elastic member 3225 is arranged to push the lower locking frame 3222 to disengage from the supporting shaft 321 so as to allow the supporting shaft 321 and the adjustable handle 31 to rotate.

The locking mechanism 32 further comprises a resilient element 324 mounted at the supporting shaft 321 underneath the lower locking frame 3222, a biasing plate 326 mounted underneath the lower locking frame 3222, and a mounting plate 327 mounted at the lower end portion of the supporting shaft 321, wherein the resilient element 324 is sandwiched between the mounting plate 327 and the biasing plate 326 and is arranged to normally exert an upward biasing force against the biasing plate 326 so that when the locking force is released, the supporting shaft 321 is pushed outwardly with respect to the main housing 10, wherein a user is able to free rotate the adjustable handle 31 in order to alter an angle of inclination between the adjustable handle 31 and the main housing 10.

According to the preferred embodiment of the present invention, the main housing 10 further has a leg compartment 17 formed at a bottom portion of the main housing 10, wherein the angle adjusting arrangement 30 further comprises an adjustable leg frame 33 comprising an adjustable leg 331 pivotally mounted in the leg compartment 17 to operate between a folded position and an unfolded position. In the folded position, the adjustable leg 331 is pivotally folded to substantially receive in the leg compartment 17 so that a user may utilize the spotlight of the present invention by manually folding it on the adjustable handle 31. On the other hand, when the adjustable leg 331 operates in the unfolded position, the adjustable leg 331 is pivotally and outwardly unfolded and extended to form a predetermined angle of inclination with respect to the main housing 10. Moreover, the adjustable leg 331 is adapted to stand on a flat surface, such as a ground surface, for allowing the spotlight to stand on the supporting surface for providing illumination without requiring the user to manually hold the spotlight.

Thus, the adjustable leg 331 comprises a leg member 3311 having an upper end portion pivotally mounted to a sidewall of the leg compartment 17, and a supporting member 3312 provided at and longitudinally extended from a lower end portion of the leg member 3311, wherein the supporting member 3312 has a supporting surface 3313 formed thereon for supporting the spotlight on the ground surface when the adjustable leg 331 operates in the unfolded position.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A spotlight, comprising:

a main housing;

an illumination device received in said main housing for generating illumination; and an angle adjusting arrangement which comprises:

an adjustable handle, having a predetermined curvature, outwardly extended and rotatably mounted to said main housing and is arranged to selectively and rotatably move with respect to said main housing so as to selectively adjust an angle of inclination between said adjustable handle and said main housing; and a locking mechanism coupled between said adjustable handle and said main housing for selectively retaining said adjustable handle at a predetermined angle of inclination with respect to said main housing so that when said adjustable handle is held by a user, said illumination device is arranged to generate said illumination at a predetermined orientation corresponding with said angle of inclination of said adjustable handle, wherein said main housing is elongated in shape and has a front end portion, a main portion rearwardly extended from said front end portion, and a receiving cavity formed within said main housing to define a battery compartment at said main portion for accommodating a predetermined number of batteries, and an electrical compartment for receiving said illumination device, wherein said main housing further has a control portion provided at an intersection between said front end portion and said main portion for accommodating said locking mechanism of said angle adjusting arrangement and for rotatably supporting said adjustable handle, wherein said spotlight further comprises a control mechanism accommodated in said control portion of said main housing and is operatively connected to said illumination device for controlling an operation thereof, wherein said adjustable handle of said angle adjusting arrangement is elongated in shape and is rearwardly extended from said control portion of said main housing, wherein said adjustable handle has a curved cross sectional shape so as to ergonomically fit a user's hand, and when said adjustable handle is rotatably moved with respect to said main housing, an angle of inclination of said adjustable handle with respect to said main housing is altered, wherein said locking mechanism of said handle adjusting arrangement comprises a supporting shaft extended from a front end of said adjustable handle such that said adjustable handle is capable of rotating about said supporting shaft, a shaft locker supported at said control portion of said main housing and is operatively coupled with said supporting shaft, and a locker switch provided on said control portion of said main housing for selectively locking a rotational movement of said supporting shaft, wherein said adjustable handle and said supporting shaft are coupled with said shaft locker in such a manner that said supporting shaft and said adjustable handle are also capable of moving in a longitudinal manner, wherein said supporting shaft further has a locking slot formed thereon, wherein said shaft locker comprises an upper locking frame and a lower locking frame overlappedly received in said upper locking frame, wherein each of said upper locking frame and said lower locking frame has a through slot formed thereon for allowing said supporting shaft to pass therethrough, wherein said lower locking frame has locking latch inwardly extended from a sidewall of said corresponding through slot in such a manner that said locking latch is arranged to engage with said locking slot of said supporting shaft so as to restrict rotational as well as linear movement thereof.

2. The spotlight, as recited in claim 1, wherein said locker switch comprises a locking shaft member movably provided on said control portion of said main housing, and a switching knob pivotally mounted on said control portion, wherein said locking shaft member is extended from said switching knob to selectively bias against said lower locking frame so as to allow said locking latch to selectively engage to and disengage from said locking slot.

3. The spotlight, as recited in claim 2, wherein said shaft locker further comprises an elastic member mounted on said upper locking frame for normally exerting an axial biasing force toward said lower locking frame for disengaging said lower locking frame from said supporting shaft, so that when said switching knob is pivotally moved to release a biasing force against said lower locking frame, said elastic member is arranged to push said lower locking frame to disengage from said supporting shaft so as to allow said supporting shaft and said adjustable handle to rotate.

4. The spotlight, as recited in claim 3, wherein said locking mechanism further comprises a resilient element mounted at said supporting shaft underneath said lower locking frame, a biasing plate mounted underneath said lower locking frame, and a mounting plate mounted at said lower end portion of said supporting shaft, wherein said resilient element is sandwiched between said mounting plate and said biasing plate and is arranged to normally exert an upward biasing force against said biasing plate so that when said locking force is released, said supporting shaft is pushed outwardly with respect to said main housing, wherein a user is able to freely rotate said adjustable handle in order to alter an angle of inclination between said adjustable handle and said main housing.

5. The spotlight, as recited in claim 4, wherein said main housing further has a leg compartment formed at a bottom portion of said main housing, wherein said angle adjusting arrangement further comprises an adjustable leg frame comprising an adjustable leg pivotally mounted in said leg compartment to operate between a folded position and an unfolded position, wherein in said folded position, said adjustable leg is pivotally folded to substantially receive in said leg compartment wherein in said unfolded position, said adjustable leg is pivotally and outwardly unfolded and extended to form a predetermined angle of inclination with respect to said main housing.

6. The spotlight, as recited in claim 5, wherein said adjustable leg comprises a leg member having an upper end portion pivotally mounted to a sidewall of said leg compartment, and a supporting member provided at and longitudinally extended from a lower end portion of said leg member, wherein said supporting member has a supporting surface formed thereon for supporting said spotlight on said ground surface when said adjustable leg operates in said unfolded position.

7. The spotlight, as recited in claim 6, wherein said illumination device comprises at least one illuminator supported in said front end portion of said main housing, and is adapted for electrically connecting to said battery received in said battery compartment of said main housing for acquiring electricity to provide illumination.

8. The spotlight, as recited in claim 7, wherein said illumination device further comprises a light reflector provided in said front end portion of said main housing, wherein said light reflector is conical in structure and is arranged to reflect light coming out from said illuminator toward an exterior of said main housing.

9. The spotlight, as recited in claim 5, wherein said control mechanism comprises a control switch operatively provided on said control portion of said main housing for selectively actuating said illuminator to generate illumination, wherein said control switch is provided at a position in front of said adjustable handle so as to allow said user to conveniently operate said control switch while holding said adjustable handle.

10. The spotlight, as recited in claim 6, wherein said control mechanism comprises a control switch operatively provided on said control portion of said main housing for selectively actuating said illuminator to generate illumination, wherein said control switch is provided at a position in front of said adjustable handle so as to allow said user to conveniently operate said control switch while holding said adjustable handle.

11. The spotlight, as recited in claim 8, wherein said control mechanism comprises a control switch operatively provided on said control portion of said main housing for selectively actuating said illuminator to generate illumination, wherein said control switch is provided at a position in front of said adjustable handle so as to allow said user to conveniently operate said control switch while holding said adjustable handle.

* * * * *